US011608729B2

(12) United States Patent
Hay et al.

(10) Patent No.: US 11,608,729 B2
(45) Date of Patent: Mar. 21, 2023

(54) SYSTEM AND METHOD TO CONTROL A DUAL MOTOR ROTARY STEERABLE TOOL

(71) Applicant: Halliburton Energy Services, Inc., Houston, TX (US)

(72) Inventors: Richard T. Hay, Spring, TX (US); Raymond C. Smith, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 87 days.

(21) Appl. No.: 16/757,150

(22) PCT Filed: Dec. 29, 2017

(86) PCT No.: PCT/US2017/069124
§ 371 (c)(1),
(2) Date: Apr. 17, 2020

(87) PCT Pub. No.: WO2019/133003
PCT Pub. Date: Jul. 4, 2019

(65) Prior Publication Data
US 2021/0198996 A1 Jul. 1, 2021

(51) Int. Cl.
*E21B 44/00* (2006.01)
*E21B 7/06* (2006.01)
*E21B 21/08* (2006.01)

(52) U.S. Cl.
CPC ..... *E21B 44/00* (2013.01); *E21B 7/06* (2013.01); *E21B 21/08* (2013.01)

(58) Field of Classification Search
CPC ..... E21B 44/00; E21B 7/06; E21B 21/08
See application file for complete search history.

(56) References Cited

U.S. PATENT DOCUMENTS

| | | | | |
|---|---|---|---|---|
| 8,151,907 | B2 | 4/2012 | MacDonald | |
| 8,381,839 | B2 | 2/2013 | Rosenhauch | |
| 8,567,528 | B2 | 10/2013 | Comeau et al. | |
| 9,506,335 | B1 | 11/2016 | Smith | |
| 2006/0243493 | A1* | 11/2006 | El-Rayes | E21B 4/02 175/107 |
| 2009/0272578 | A1 | 11/2009 | Macdonald | |

(Continued)

OTHER PUBLICATIONS

International Search Report and Written Opinion dated Sep. 28, 2018 for PCT Application No. PCT/US2017/069124 filed Dec. 29, 2017. (17 pages).

*Primary Examiner* — Dany E Akakpo
(74) *Attorney, Agent, or Firm* — K&L Gates LLP

(57) ABSTRACT

A drilling system for drilling a wellbore that includes a drill string rotatable in a first direction. The system also includes a bottom hole assembly (BHA) that includes: a drill bit, a housing with a bore, a first fluid-driven motor in fluid communication with the bore and connected with and configured to rotate a portion of the BHA in a second direction opposite the first direction, a second fluid-driven motor in fluid communication with the bore and connected with and configured to rotate the drill bit, a valve in fluid communication with a vent including a flow path arranged to direct fluid away from any one or both of the fluid-driven motors, and a controller in communication with and configured to adjust a drilling parameter of the BHA by controlling the valve to adjust a flow rate of the fluid output from the valve into the vent.

18 Claims, 10 Drawing Sheets

(56) References Cited

U.S. PATENT DOCUMENTS

| | | | | |
|---|---|---|---|---|
| 2011/0036631 | A1 | 2/2011 | Prill et al. | |
| 2015/0090497 | A1* | 4/2015 | Marson | E21B 7/067 175/48 |
| 2015/0292280 | A1* | 10/2015 | Lewis | E21B 21/103 175/25 |
| 2015/0337606 | A1 | 11/2015 | Bowley et al. | |
| 2016/0258288 | A1 | 9/2016 | Hay et al. | |
| 2017/0030183 | A1 | 2/2017 | Smith | |

* cited by examiner

SYSTEM AND METHOD TO CONTROL A DUAL MOTOR ROTARY STEERABLE TOOL

BACKGROUND

This section is intended to provide relevant background information to facilitate a better understanding of the various aspects of the described embodiments. Accordingly, it should be understood that these statements are to be read in this light and not as admissions of prior art.

Steerable drilling systems are used to control and change the direction of drilling, such as to controllably drill a deviated borehole from a straight section of a wellbore. A dual motor steerable drilling system is one example of a steerable drilling system that employs a downhole motor (positive displacement motor (PDM) or "mud motor") powered by drilling fluid (mud) pumped from the surface to rotate a bit. The motor and bit are supported from a drill string that extends from the well surface and the mud flow is used to rotate a rotor within a stator. The motor rotates the bit with a drive linkage extending through a bent sub or bent housing positioned between the power section of the motor and the drill bit. A second mud motor is employed to maintain the bent housing and rotating drill bit in a stationary position in the wellbore by rotating the bent housing counter to the rotational direction of the drill string.

In some systems, controlling the drilling direction relies on receiving drilling parameters (e.g., toolface) measured downhole at the surface by way of a telemetry system. When the surface system receives the measured drilling parameters, a surface controller compares the measured drilling parameter against a desired target drilling parameter to determine whether there is a sufficient difference to warrant a correction. However, the feedback received by the surface system must be accurate. For example, stick-slip events can render the measured parameter received at the surface inaccurate as the orientation of the BHA may change by the time the measured parameter is received at the surface.

Controlling the drilling direction can be accomplished by controlling the speed of the PDMs. Controlling the speed of the PDMs is generally dependent upon on the flow rate through the space between the rotor and stator. The speed is controlled by the flow rate and the number of lobes the PDM has in the motor profile. For a Moineau style PDM there is one lobe extra in the stator than that of the rotor. PDMs also include a number of stages, which are how many pockets of propagating fluid are flowing down the length of the motor. For example, a 5.1 stage motor would have enough length to support 5.1 pockets of at any given time between the rotor and the stator. A general expression for the rotation of the stator per unit volume of fluid can be described in the equation:

$$C = \frac{a/b^{-1}}{Q} \tag{1}$$

Where 'a' is the pitch radius of the stator (number of lobes), 'b' is the pitch radius of the rotor (number of lobes), 'Q' is the volume flowing through one stage of the PDM at any given time and 'C' then typically describes the revolutions per unit of fluid volume fluid. The rotor rotates in the opposite direction of the stator if the stator was allowed to freely move as drilling fluid is pumped through the motor. The relative speed between the rotor and the stator could be derived with Equation 1. Other factors that can affect the rotation speed of a PDM include leakage rate past the rotor and stator, motor efficiency with varying loads applied and volume of fluid flowing to the motor that can bypass the rotor stator stage pathway.

DESCRIPTION OF THE DRAWINGS

Embodiments are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
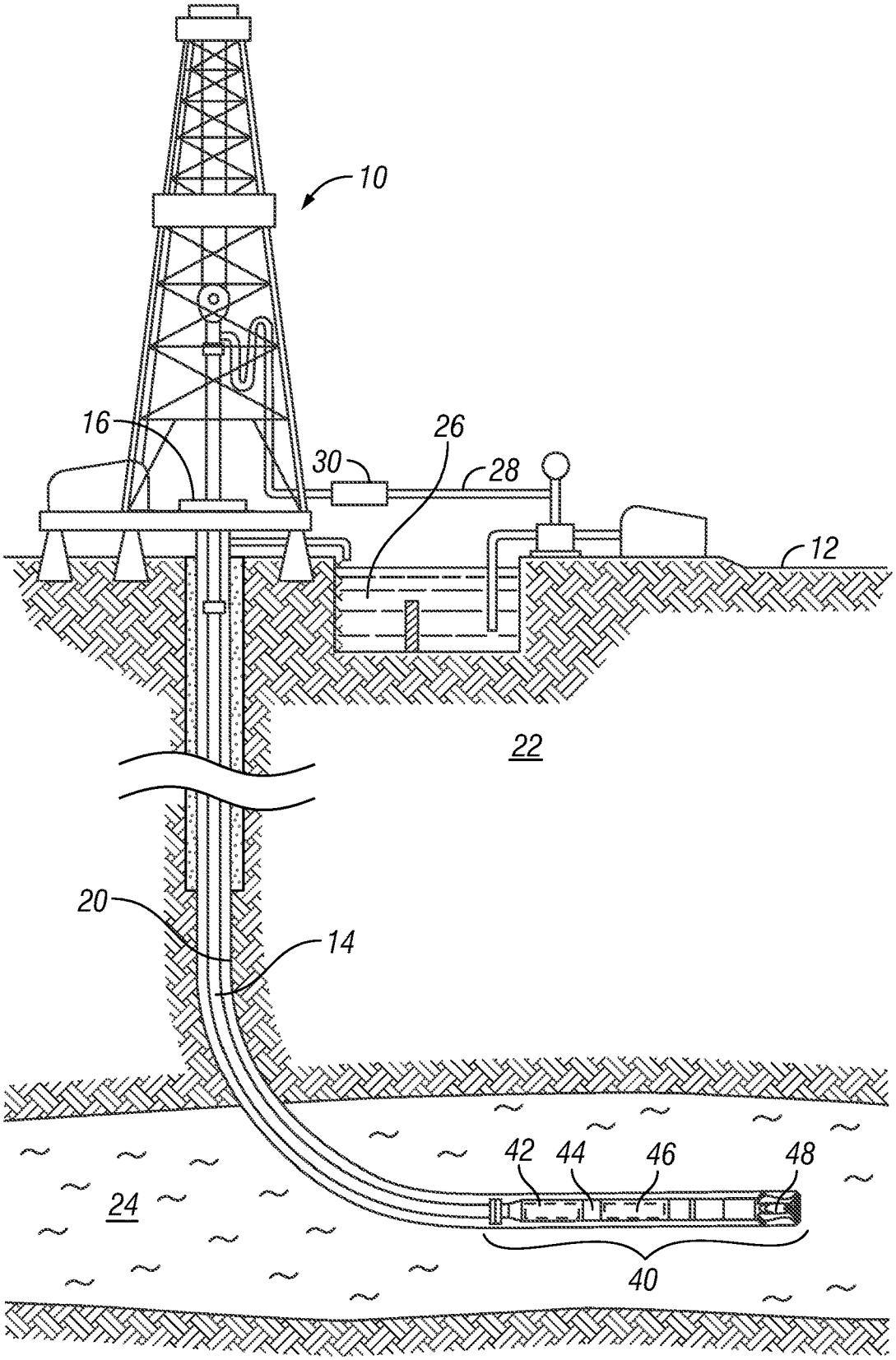
FIG. 1 depicts an elevation view of an example well system, according to one or more embodiments.

FIG. 1 shows an elevation view of a well system, according to one or more embodiments of the present disclosure. The well system comprises a drilling rig 10 at the surface 12, supporting a drill string 14. In some embodiments, the drill string 14 may be a drill string comprising an assembly of drill pipe sections which are connected end-to-end through a work platform 16. In other embodiments, the drill string 14 may also comprise coiled tubing rather than individual drill pipe sections. A drill bit 18 is coupled to the lower end of the drill string 14, and through drilling operations the bit 18 creates a wellbore 20 through earth formations 22 and 24. The drill string 14 also has on its lower end a bottom hole assembly (BHA) 40 which comprises the drill bit 48, an upper fluid-driven motor 42, a controller section 44, and a lower fluid-driven motor 46. The BHA 40 may also be referred to herein as a downhole tool.

Drilling fluid is pumped from a pit 26 at the surface through the line 28, into the drill string 14 and to the drill bit 48. After flowing out through the face of the drill bit 18, the drilling fluid rises back to the surface through the annular area between the drill string 14 and the wellbore 20. At the surface, the drilling fluid is collected and returned to the pit 26 for filtering. The drilling fluid is used to lubricate and cool the drill bit 48 and to remove cuttings from the wellbore 20.

The controller section 44 controls the operation of a telemetry device (not shown) and orchestrates the operation of downhole components, such as the fluid-driven motors. As described in more detail, the controller section 44 also actuates a valve within the bottom hole assembly 40. The controller section 44 also processes data received from various sensors and produces encoded signals for transmission to the surface via the telemetry device, which may transmit and receive signals in the form of mud pulses transmitted within the drill string 14. Mud pulses may be detected at the surface by a mud pulse receiver 30. Other telemetry systems may be equivalently used (e.g., acoustic telemetry along the drill string, wired drill pipe, etc.). In addition to the downhole sensors, the system may include a number of sensors at the surface of the rig floor to monitor different operations (e.g., rotation rate of the drill string, mud flow rate, etc.). The controller section 44 may also be a measurement/logging while drilling tool (MWD/LWD), which includes other sensors and instruments for measuring formation properties and is rotationally coupled with a bent housing 50 such that the controller section 44 can measure and adjust the orientation of the bent housing 50 through controlling the rotation speed of the upper motor 42. To do so, the controller section 44 includes orientation sensors to track the position of the bent housing 50.

For the purposes of this disclosure, clockwise rotation is considered positive rotation and counter clockwise rotation is considered negative rotation and all such rotation shall be relative to the earth looking down the borehole as a point of reference.

Figure 2:
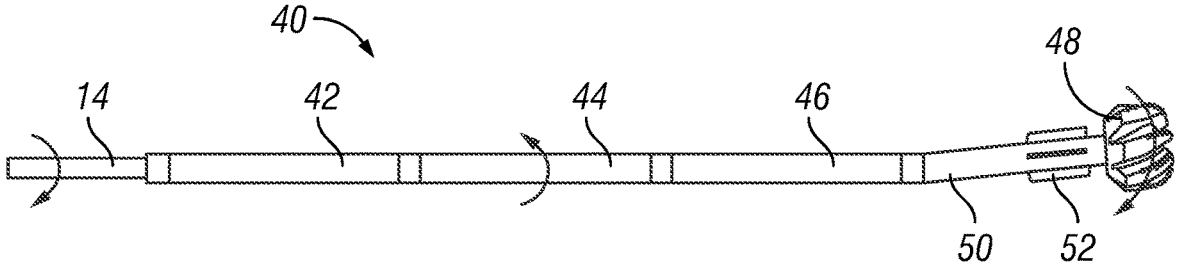
FIG. 2 shows a schematic view of a BHA employed to steer a drill bit along a wellbore trajectory, according to one or more embodiments.

FIG. 2 shows a schematic view of the BHA 40 employed to steer the drill bit along a wellbore trajectory, in accordance with one or more embodiments. The upper fluid-driven motor 42 rotates counter to the rotational direction of the drill string 14 to maintain a portion of the BHA 40 in a stationary position in the wellbore. That is, the upper fluid-driven motor 42 rotates in a direction opposite the rotational of the drill string 14 such that a portion of the BHA 40 is stationary in the wellbore relative to the rotating drill string 14. The lower fluid-driven motor 46 rotates the drill bit 48 to advance the wellbore. The BHA 40 also includes a bent housing 50 and wellbore stabilizers 52 to assist in controlling the drilling direction of the BHA 40. The wellbore stabilizers 52 extend radially from the BHA 40 in a fixed or adjustable position.

Figure 3:
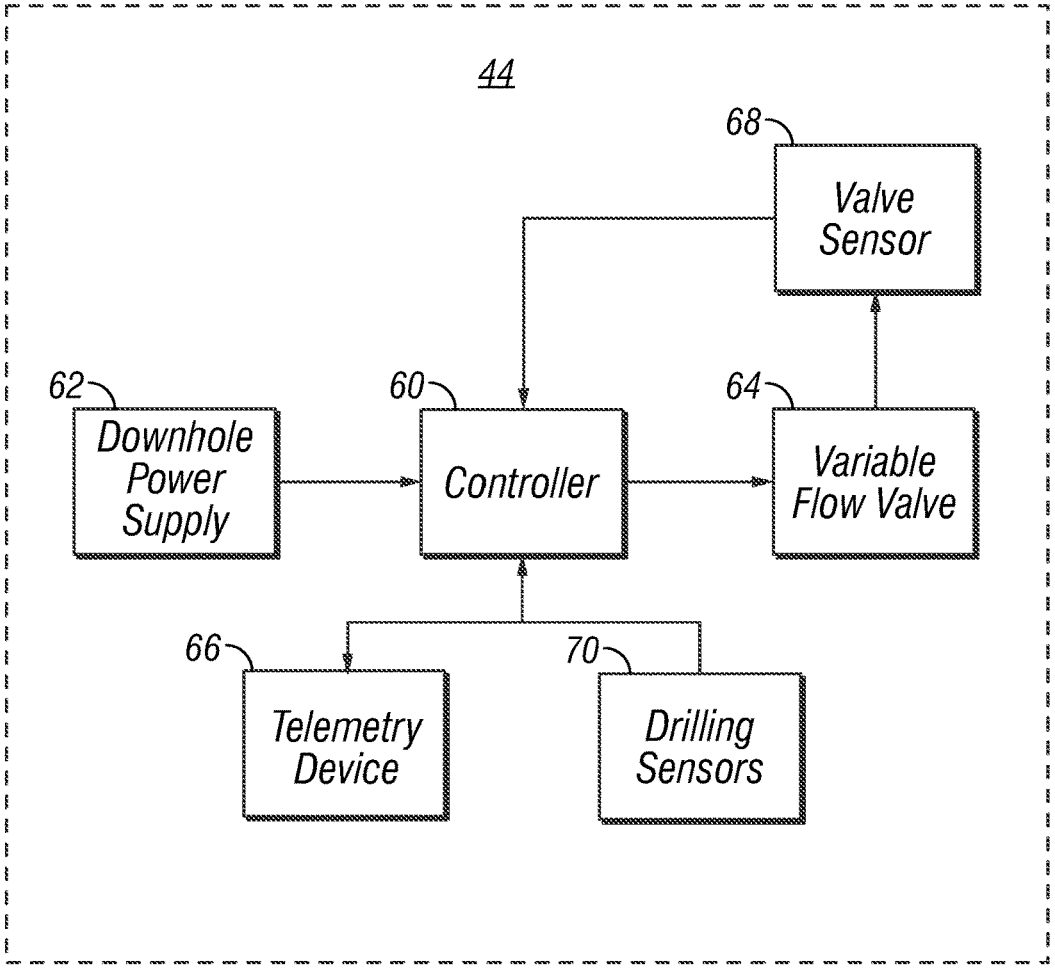
FIG. 3 depicts a block diagram of a controller section used to steer the BHA, according to one or more embodiments.
Figure 4:
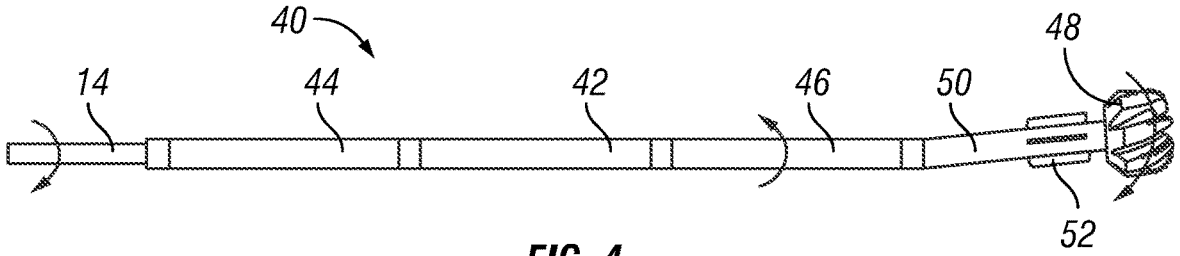
FIG. 4 shows a schematic view of the BHA with the controller section positioned above the motors, according to one or more embodiments.

The controller section 44 is positioned between the upper and lower fluid-driven motors 42 and 46 to monitor the drilling parameters of the BHA 40 and control a drilling parameter by adjusting the flow rate output to any one or both of the fluid-driven motors 42 and 46 as further described herein. For example, FIG. 3 shows a block diagram of the controller section 44 including various sensors to measure the drilling parameters of the BHA and steer the drill bit 48. The controller section 44 includes a controller 60, a downhole power supply 62, a variable flow valve 64, a telemetry device 66, and sensors including a valve sensor 68 and drilling sensors 70 for operating the BHA 40. The drilling sensors 70 provide the controller 60 with measurements of drilling parameters, including but not limited the drilling orientation of the BHA 40 (e.g., azimuth, inclination, and toolface angle), the rotational speed of the drill string 14, rotational speeds for the fluid-driven motors 42 and 46. The drilling sensors 70 may also include a temperature sensor, a pressure gauge, a flow meter for one or both motors, a strain sensor used to measure the axial force such as weight on bit, torque sensors to measure the torque on the bit, the bent housing and the drill string. For orientation and rotation speeds sensors a gyro or magnetometer, and/or an accelerometer may be used. Also for geo-referencing to a stationary direction a man-made signal can be utilized such as an acoustic, electromagnetic or magnetic signal within a detectable range such as on surface or originating from nearby wellbore, such as a single wire guidance method using electric current to source a magnetic field, or current excitation on the tubing strings in the nearby well or any such combination of excitation signals that can be used to provide an artificial orientation signal rather than an earth generated signal such as the earth magnetic pole, earth gravity or earth spin axis. The magnetometer and accelerometer may be tri-axial sensors used to measure the orientation of the BHA 40 in the wellbore relative to the earth. It should also be appreciated that the controller section 44 may be positioned between the drill string 14 and the upper fluid-driven motor 42 as depicted in FIG. 4.

The controller 60 includes a processor and a memory device for storing instructions to operate the BHA 40 to adjust a drilling parameter to a target drilling parameter value, which may be pre-set or transmitted to the controller 60 from the surface. The controller 60 may also have instructions for the BHA 40 to follow a desired wellbore trajectory or path while drilling. For example, the controller may receive measurements from the drilling sensors 70 and commands from the surface to determine an error value between a target drilling parameter value (e.g., target toolface) or path and the measured drilling parameter (e.g., measured toolface) or path. The controller 60 transmits a control signal to an actuator (such as a servo motor or transducer) coupled to the valve 64 to actuate the variable flow valve 64 to control the outlet size of the valve 64 and adjust the flow rate of fluid input to any one or both of the fluid-driven motors 42 and 46. The variable flow valve 64 may include a poppet valve, piston valve, gate valve, rotary disk valve, a barrel valve, or any suitable control valve as further described herein with respect to FIGS. 9 and 10. The valve sensor 68 provides measurements indicative of the flow rate output by the variable flow valve (such as an indication of the valve outlet size or position of the gate of the valve).

The controller 60 uses the valve measurements and the measured drilling parameters to determine a rotational speed of any one or both of the fluid driven motors 42 and 46 adjust a drilling parameter with respect to a target drilling parameter. For example, the upper fluid-driven motor 42 may be rotating the BHA 40 such that BHA 40 remains stationary relative to the rotating drill string 14. To orient the bent housing 50, the controller 60 adjusts the flow rate of fluid input to the upper fluid-driven motor 42 by controlling the output flow rate of the variable flow valve 64 which vents fluid away from the upper motor 42. As the upper fluid-driven motor 42 reduces in rotational speed relative to the rotational speed of the drill string 14, the BHA 40 rotates with the drill string 14 and adjusts the toolface angle of the BHA 40 to orient the bent housing 50 in the desired drilling direction. Alternatively, the flow through the upper motor 42 may be increased to the point that it rotates the bent housing counter clockwise or against the rotation speed of the drill pipe to adjust the bent housing to a desired orientation. Once the bent housing 50 is in a desired orientation the flow through the upper motor is adjusted such that the speed of the bent housing 50 stops rotational movement even though the drill string 14 is rotating to the right. This essentially balances the bent housing 50 at a desired orientation. Thus, the desired orientation may be obtained by adjusting the flow and thus drift of the bent housing 50 orientation to a desired target value.

The downhole power supply 62 may also include a fluid driven motor driving an electric generator to provide power to the electronic components of the controller section 44. The downhole power supply 62 may employ other forms of electrical energy such as batteries or an electrical power generator that can leverage off of the difference in rotation speeds between the drive shaft of either fluid driven motors 42 and 46 and the motor housing. A direct drive power generator system across such a downhole power supply configuration may also be employed to boost the power factor and efficiency of the generator since the motor would operate at a very low rotational speed. Other solutions could include a gear arrangement to boost the generator armature speed to improve power generation efficiency.

As previously discussed, the controller 60 may receive instructions from the surface or transmit sensor measurements to the surface via the telemetry device 66. Received commands or data from surface could be sent downhole in the form of pressure pulses or EM telemetry or any other type of telemetry known in the art. In the case of pressure pulses a downhole pressure transduce can be used to convert the pressure pulses into electrical signals which the controller 60 can decode into data or commands. At the surface, a drilling operator may monitor the drilling orientation of the BHA 40 and transmit desired instructions to the controller 60 using various forms of downlink telemetry systems. The kinds of commands received by the controller 60 can be changes to a target toolface, changes to the tolerances allowable for a drilling parameter such as a toolface target, a formation parameter to follow along the wellbore trajectory (such as a resistivity value or a distance to bed boundary), or a distance to maintain with another nearby man-made structure such as a wellbore, changes to a desired wellbore trajectory, target depth, target inclination, target azimuth, or other information or commands to aid in steering the well path in a desired direction, or a desired path.

As previously discussed, the controller 60 adjusts a localized drilling parameter by controlling the flow rate input to any one of the fluid-driven motors 42 and 46. The flow rate input is the flow between the rotor 78 or 80 and stator 76 or 75 of each motor, which generates the relative rotation between the rotor and the stator. For example, FIGS. 5-8 show cross-sectional views of various flow paths employed to adjust the flow rate input to any one of the fluid-driven motors 42 and 46.

Figure 5:
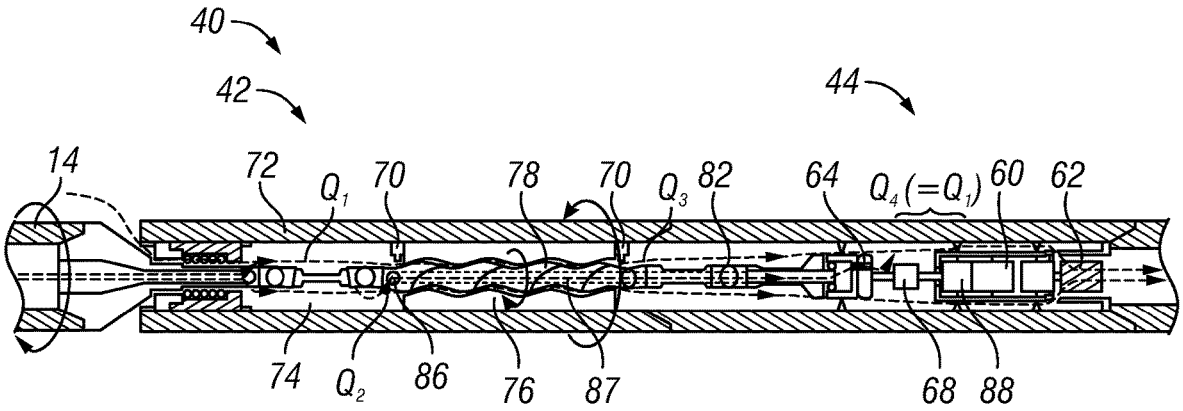
FIGS. 5-8 show cross-section views of BHAs employing various venting configurations, according to one or more embodiments.
Figure 5:
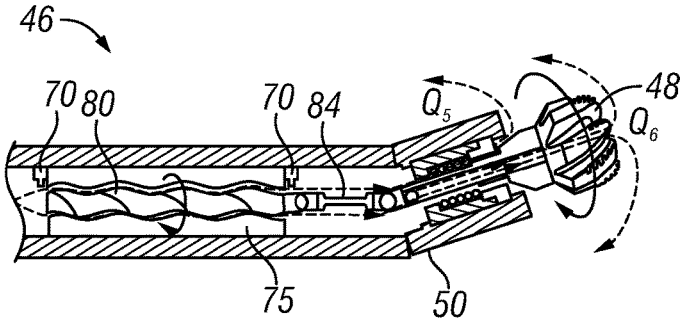

FIG. 5 shows a cross-sectional view of the BHA 40 where the variable flow control valve 64 is employed to adjust the flow rate of fluid input to the upper fluid-driven motor 42, in accordance with one or more embodiments. As shown, the BHA 40 includes a housing 72 comprising a bore 74 which receives drilling fluid flowing through the drill string 14, which is connected to a drive shaft of the motor 42. Each of the fluid-driven motors 42 and 46 is a turbine motor with a stator 76, 75 and a rotatable blade-bearing rotor 78, 80 disposed inside the stator 76, 75. The rotor 78 is connected with the drive shaft by a universal coupling in the bore 74. Pressurized drilling fluid that flows into each of the fluid-driven motors 42 and 46 between the rotor 78, 80 and stator 76, 75 imparts a torque force between the rotor and stator causing the rotor 78, 80 to rotate relative to the stator 76, 75. A universal coupling 82, 84 is coupled to each of the rotors 78, 80 and configured to output the rotational drive forces generated by each of the fluid-driven motor 42 and 46 for their respective purpose as previously discussed.

In FIG. 5 it is noted that in this configuration it is a clockwise motor but run upside down where the rotor and drive train connects to the upper drill string 14. Thus, looking downhole the upper fluid driven motor housing 72 will rotate counter clockwise relative to the drill string when drilling fluid is pumped through the upper fluid-driven motor 42. Drilling fluid flows inside of the drill string 14 into the drive shaft of the upper fluid-driven motor 42, through the bearing section and then out into bore 74 through exit ports on the drive shaft. This is considered flow rate "Q1" which in this case matches the flow rate flowing down the drill string 14 and eventually back up the wellbore annulus between the drill string 14 and the wellbore 20.

The rotor 78 of the upper fluid-driven motor 42 includes a vent 86 with a flow path to direct some of the drilling fluid away from the rotor stator stages of the upper fluid-driven motor 42 by flowing fluid into a conduit 87, which runs inside the rotor 78 and the drive shaft 82. The fluid flows through the conduit 87 and exits through the variable flow valve 64 into the bore 74. The flow rate of the fluid allowed through the vent 86 is adjusted by the outlet size of the variable flow valve 64. When the valve 64 is closed, pressure builds in the conduit 87 to block fluid from entering the conduit 87 thus forcing all of the Q1 fluid between the rotor stator stages. The controller 60 provides control signals to an actuator 88 to adjust the outlet size of the valve 64 as further discussed below. Therefore, as depicted in FIG. 5, the controller 60 is operable to adjust the flow rate of fluid input to the upper fluid-driven motor 42 via the amount of fluid allowed to bypass through the vent 86. The valve 64 may also be actuated in a closed positioned to direct all the fluid in the housing through the upper fluid-driven motor 42.

Various drilling sensors 70 may be positioned upstream and downstream from the fluid driven-motors 42 and 46 to measure drilling parameters (e.g., rotation rate, fluid temperature, fluid pressure, or flow rate) as the drilling fluid flows through the fluid-driven motors 42 and 46. The controller 60 uses these measurements to determine the rotational speed of the fluid-driven motors 42 and 46, which in turn is used to determine a target drilling parameter for the desired drilling trajectory or path. For example, pressure sensors can be positioned upstream and downstream from each motor 42 and 46 to monitor the differential pressure across each rotor stator set. As the pressure drop exhibited by a motor 42, 46 increases, the mechanical power and torque output by the motor 42, 46 also increases. The pressure differential measured can aid the controller 60 in determining how to regulate the power and torque output by the motors 42, 46, such as determining the power and torque required to maintain a stationary position for the toolface of the bent housing 50. Other drilling parameters, such as drill string 14 rotation rate, drill bit rotation rate and bent housing 50 rotation rate or any member that is rotationally coupled to these elements, can also aid in self-tuning the controller 60 in adjusting the valve 64 to operate the venting fluid volume in an appropriate range to achieve a target drilling parameter, such as the toolface of the bent housing 50.

The drilling sensors 70 may also include sensing devices to measure any one or combination of flow rate, weight on bit, torque on bit, bend on bit, or bend direction. In addition, an annular and inner pressure sensor or differential pressure sensor can be used to measure pressures across the housing of the BHA 40 and across each fluid-driven motor section. Rotor RPM sensors can also be employed as drilling sensors 70 or be integral with the controller sensors 60. When the controller section 44 is between the motors 42 and 46 and a sensor is not measuring the RPM directly, a gyroscope such as one or more rate gyros can be used to monitor the RPM of the bent housing 50, the drill string 14, and the lower rotor/drill bit drive train 84. Other methods to sense rotation can be monitoring changes in the accelerometers and/or magnetometers employed to measure the orientation of the BHA 40. Yet another method can be to use a north seeking gyro to reference off of the Earth's spin access. Yet another method is to use an artificial reference created by a man-made source such as a magnetic or electromagnetic field induced on surface or on a nearby man-made structure such as another wellbore or wellbore branch. This would create a stationary reference field. Other forms of an artificial reference created in such locations could be acoustic or ionizing radiation sources or other forms of radiated energy from a fixed point or region.

As such the drilling sensors 70 measure a drilling parameter, which may comprise any one or combination of a flow rate of the fluid in the housing, a pressure in the housing, a weight on bit, a torque on bit, a bend on bit, a rotational speed of the first fluid-driven motor, a rotational speed of the second fluid-driven motor, a rotational speed of the drill string, an azimuth of the downhole tool, a toolface of the downhole tool, or an inclination of the downhole tool.

Figure 6:
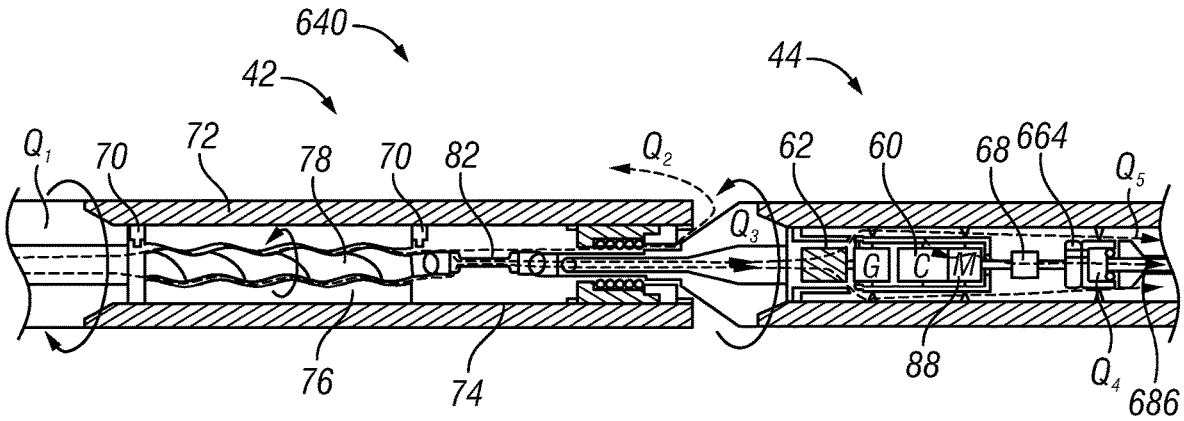
Figure 6:
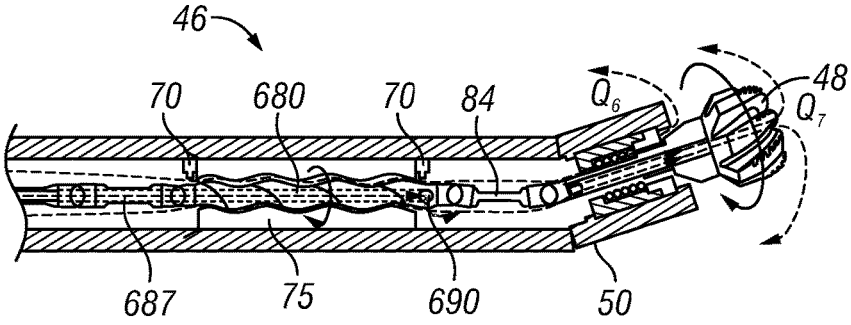

The BHA 40 may also employ other flow paths to direct drilling fluid away from any one or both of the fluid-driven motors 42 and 46, in accordance with one or more embodiments. As shown in FIG. 6, the BHA 640 has the valve 664 configured to allow adjustment of fluid flow into the lower fluid-driven motor 46. The vent 686 is positioned in the controller section 44 to capture some of the fluid flowing in the controller section 44 when the valve 664 is at least partially open. In the BHA 640 though, the controller section 44 is a separate housing from and rotatable with respect to the housing 72, although they may be considered parts of the same housing. As an example, the controller section 44 may be part of a controller collar or MWD collar. The valve 664 is in fluid communication with the vent 686, which includes a flow path that directs some of the drilling fluid in the controller section 44 to bypass the lower fluid-driven motor 46. The rotor 680 includes a conduit 687 that runs through the body of the rotor 680, the universal coupling, and the drilling fluid is directed through the conduit 687 and released through an outlet 690 positioned downstream from the lower fluid-driven motor 46. The drilling fluid is then allowed to discharge out the drill bit 48. The venting configuration depicted in FIG. 6 allows the controller 60 to adjust the rotational speed of the lower motor 46, which in turn controls the rotational speed of the drill bit 48. This coupling serves to remove radial motion of the rotor from affecting the valve 664 such that the valve can remain over the inlet of the conduit path 687.

FIG. 6 depicts a downward facing upper motor 42 where the drill string 14 is connected to the housing 72. In this situation, however, a conventional PDM would try and rotate the output drive shaft clockwise, which is not the desired direction for maintaining a stationary bent housing. So, in this embodiment the upper motor 42 is a counter clockwise motor that rotates the stator counter clockwise instead of the conventional clockwise. The lower motor 46 is a clockwise motor in that it rotates the drill bit clockwise.

Figure 7:
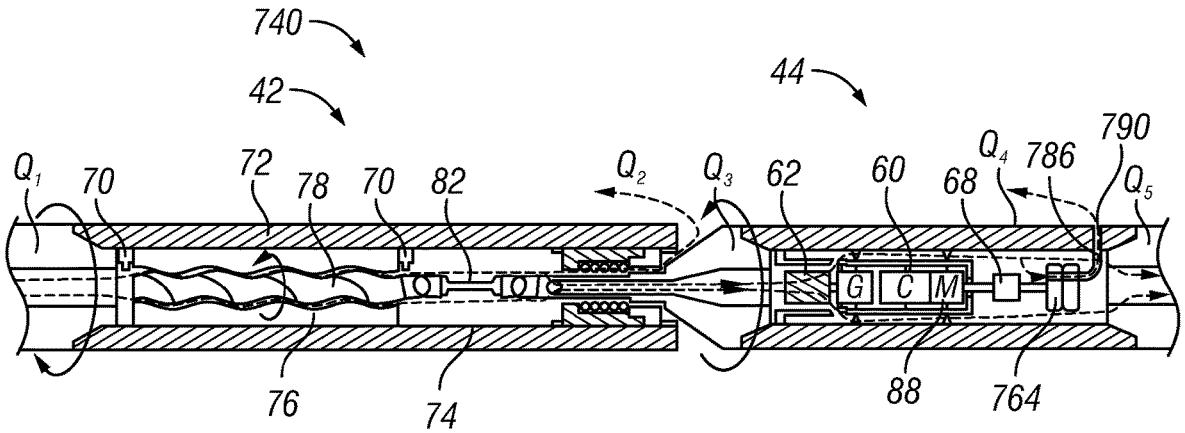
Figure 7:
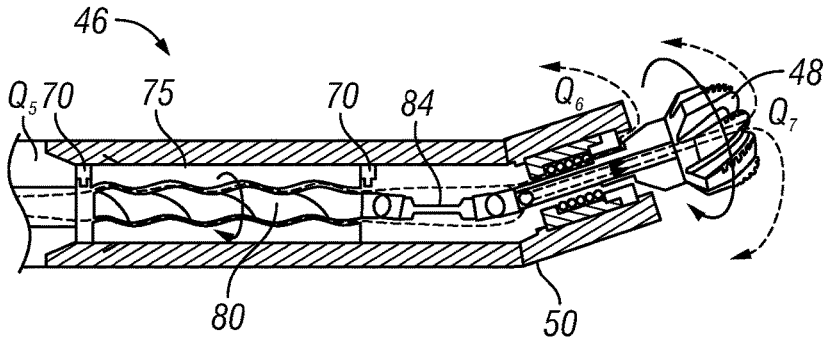

FIG. 7 depicts a BHA 740 in accordance with one or more embodiments. The BHA 740 provides for the adjustment of the fluid flow rate input to the lower motor 46 by directing some of the drilling fluid from the housing 72 into the annulus of the wellbore 20. In this configuration, the valve 764 is in fluid communication with the vent 786 which includes a flow path that directs some of the drilling fluid in the housing 72 into the annulus outside of the controller section 44. The vent 786 is positioned in the controller section 44 upstream from the lower fluid-driven motor 46, which allows the controller 60 to adjust the flow rate input to the lower fluid-driven motor 46. The vent 786 releases the drilling fluid through the outlet 790 to the exterior surface of the controller section 44. The vent 786 may also include a check valve (not shown) to only allow fluid to flow out of the housing 72 when the valve 764 is in the open position. This has the effect of raising or lowering the speed of the lower motor 46 in order to aid in the orientation of the bent housing 50. Again, since the upper motor 42 is downward facing, the upper motor 42 output rotates counter clockwise, while the lower motor 46 output rotates clockwise.

Figure 8:
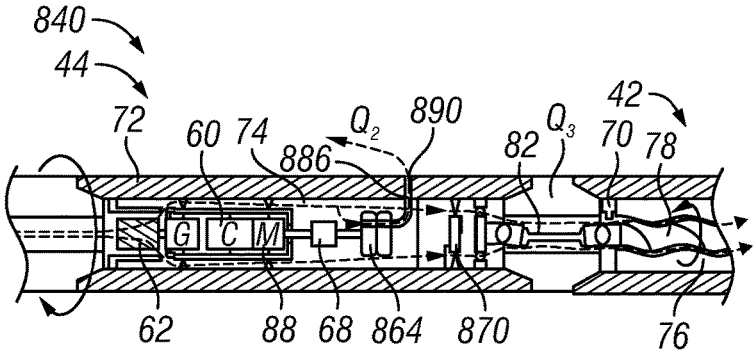
Figure 8:
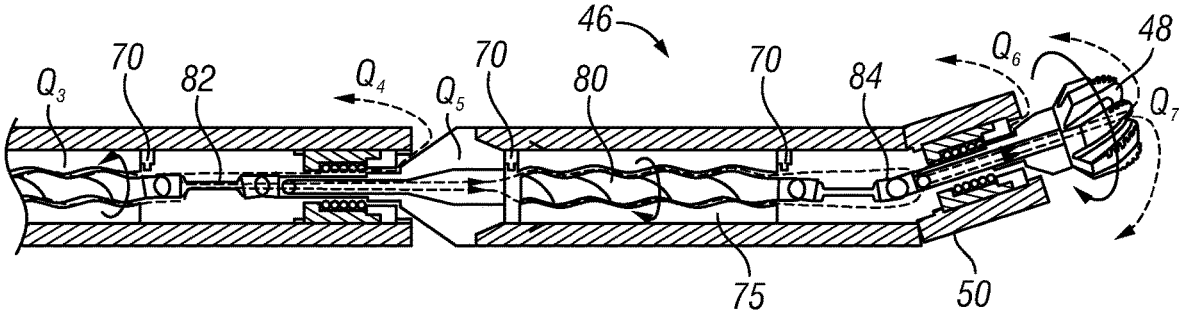

FIG. 8 depicts a BHA 840 in accordance with one or more embodiments. The venting configuration of the BHA 840 provides for the adjustment of the fluid flow rate input to the upper fluid-driven motor 42 and the lower fluid-driven motor 46 by directing some of the fluid from the housing 72 into the annulus. The valve 864 is in fluid communication with the vent 886 which includes a flow path that directs some of the drilling fluid into the annulus through the outlet 890, which is positioned upstream from the upper fluid-driven motor 42. The vent 886 is positioned in the controller section 44 upstream from the upper fluid-driven motor 42, which allows the controller 60 to adjust the flow rate input to both of the fluid-driven motors 42 and 46. The vent 886 may also include a check valve (not shown) to only allow fluid to flow out of the housing 72 when the valve 864 is in the open position. The sensor 70 measures the orientation of the bent housing 50 and transmits the value to the controller 44 above the upper motor 42. This transmission system (not shown) can use various forms of telemetry methods such as electromagnetic, acoustic, mud pulse a wired path with a slip ring to enable communication with the sensors.

The BHA 840 also utilizes the configuration depicted in FIG. 4 to provide a vent upstream from the upper fluid-driven motor 42. In other embodiments, the controller section 44 may include an additional drilling sensor 870 which measures the angular position or rotational speed of the bent housing 50. In this embodiment, the upper end of the universal coupling is connected rotation wise through to the bent housing 50. The controller 60 measures the rotation rate of the drill string 14 which it is coupled to and then measures the counter clockwise rotation of the bent housing 50. When they cancel each other out the bent housing is geo-stationary. The controller 60 uses sensor 870 to sense the orientation of the bent housing 50. The controller 60 then adjusts the amount of drilling fluid to be vented to the annulus above both the motors to adjust the position of the bent housing. In this embodiment, the upper fluid driven motor 42 is a counter clockwise rotating motor and the lower fluid driven motor 46 is a clockwise rotating motor. The more drilling fluid that is vented through valve 864 the slower both motors go. At a certain vented flow rate, a cross over point exists where the amount of venting of drilling fluid through valve 864 will result in the bent housing 50 becoming geo-stationary.

Figure 9:
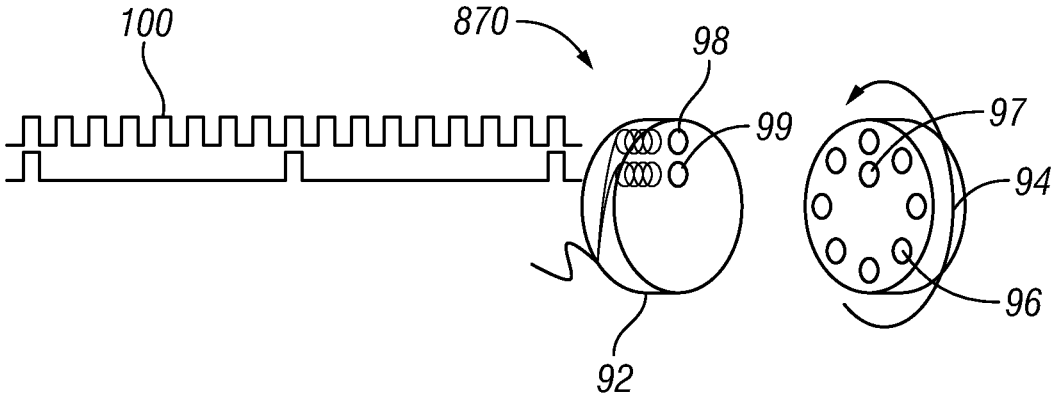
FIG. 9 shows a drilling sensor operable to measure the rotational speed output by the upper fluid-driven motor, according to one or more embodiments.
Figure 10A:
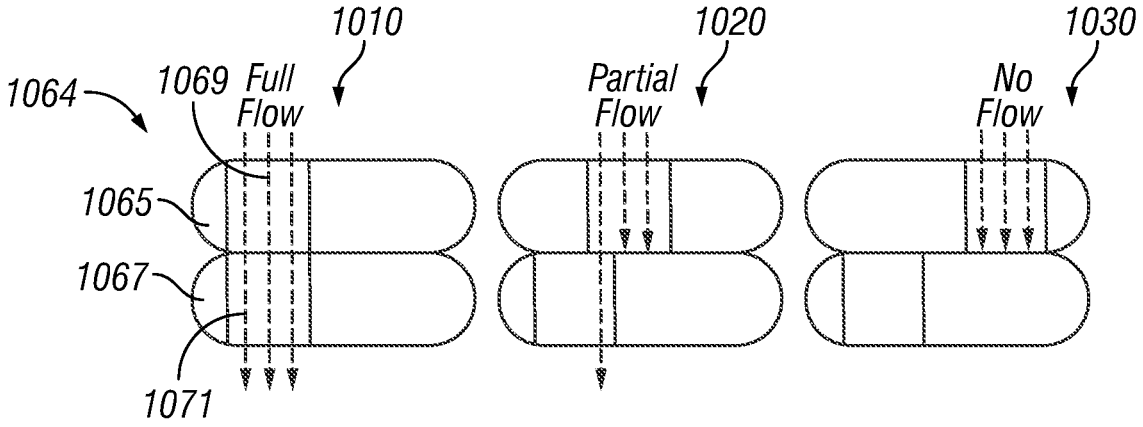
FIGS. 10A-11B show views of the variable valves employed in the BHA, according to one or more embodiments.

FIG. 9 depicts the drilling sensor 870 comprising a sensing component 92, which is fastened to the controller section 44 to remain stationary relative to the controller section 44, and a rotatable component 94 connected to the rotating drive shaft 82 of the upper fluid-driven motor which is rotationally connected with the bent housing 50. The rotatable component 94 may include magnetic devices 96 circumferentially spaced on the rotatable component 94 as well as a home or zero-point magnet 97. The sensing component 92 may include a magnetic field sensor 98 (e.g., a magnetometer or hall effect sensor), which measures the magnetic field strength exhibited by the rotatable component 94 as also may serve as a counter sensor. The sensing component 92 also includes a home or zero-point sensor 99 alignable with the home magnet 97 on the rotatable component 94. Also shown is a representative signal output by the drilling sensor 870 that the controller 60 may receive to measure the rotational speed of the upper fluid-driven motor 42. It should be appreciated that other suitable sensors may be employed to measure the drilling parameters of the BHA 40. The sensing component 92 measures both the rotation speed and the orientation of the bent housing 50 relative to the controller section 44 by measuring a single reference position during the rotation of the rotatable component 94 and then counting known rotational increments of positions away from the reference position. This is referred to as a shaft position resolver and comes in many forms known to those skilled in the art.

The BHA may employ various venting configurations and one or more controllers to adjust the rotational speed of the fluid-driven motors 42 and 46. For example, as depicted in FIG. 4, the BHA 40 employs a controller section 44 positioned between the motors 42 and 46 and vents fluid through the lower motor 46. The following table provides some of the various configurations for the BHA 40:

| Controller Location | Vent Path |
|---|---|
| One controller between motors | Vents through upper motor rotor as shown in FIG. 5. |
| One controller between motors | Vents through lower motor rotor as shown in FIG. 6. |
| One controller between motors | Vents to annulus upstream from lower motor as shown in FIG. 7 |
| One controller above upper motor. | Vents to annulus upstream from upper motor as shown in FIG. 8. |
| One controller above upper motor. | Vents through upper motor rotor as combined with aspects of FIGS. 5 and 8. |
| Two controllers: One above upper motor and a second controller between motors. | One vent to annulus upstream of upper motor and another vent to annulus upstream of lower motor as combined with aspects of FIGS. 7 and 8. |
| Two controllers: One above upper motor and a second controller between motors. | Upper motor vents through upper rotor, lower controller vents to annulus upstream from lower motor as combined with aspects of FIGS. 5, 7 and 8. |
| Two controllers: One above upper motor and a second controller between motors. | Upper controller vents to annulus upstream from upper motor, lower controller vents through lower rotor as combined with aspects of FIGS. 6 and 8. |
| Two controllers: One above upper motor and a second controller between motors. | Upper controller vents through upper rotor, lower controller vents through lower rotor as combined with aspects of FIGS. 5, 6, and 8. |
| One controller between motors. | Controls flow bypass in upper motor and lower motor. For upper motor this would be rotor bypass and for the lower motor this would be either annular or rotor venting control as combined with aspects of FIGS. 5, 6, or 7. |

Figure 10B:
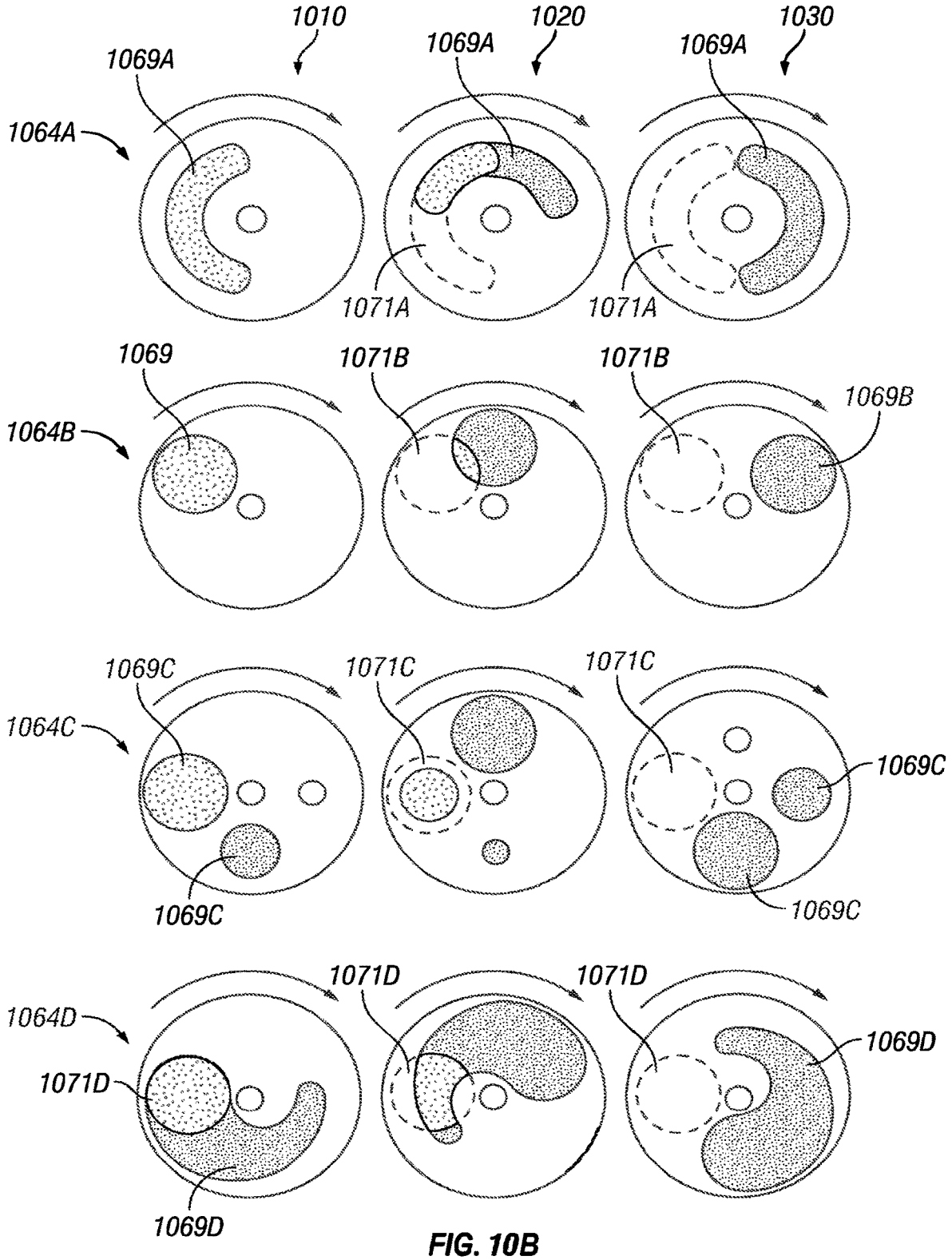

As previously discussed, the valve 64 used to vent fluid from the motors 42 and 46 may take various forms. For example, FIGS. 10A and B show cross-sectional views of the valve 1064 operating in three modes: open 1010, partially open 1020, and closed 1030. The valve 1064 is a rotary disk valve comprising a rotatable side 1065, which is rotated by the actuator 88 to vary the outlet size, and a fixed side 1067, which remains stationary relative to the rotatable side 1065. The valve 1064 receives fluid through an inlet 1069, which may take various forms as depicted in FIG. 10B, and releases fluid through an outlet 1071. As shown in FIG. 10B, the rotatable side 1065 may be rotated in different angular positions such that the valve 1064A-D is open ("full flow") 1010, partially open ("partial flow") 102, or closed ("no flow") 1030. The inlet 1069A-D may take various forms, such as the inlet 1069A having an arc shape, the inlet 1069B being circular, the inlet 1069C includes two circular inlets having different diameters, and the inlet 1069D is droplet-shaped. The inlet may take other suitable forms which allow the controller 60 to adjust the flow rate output from the valve 64.

Figure 11A:
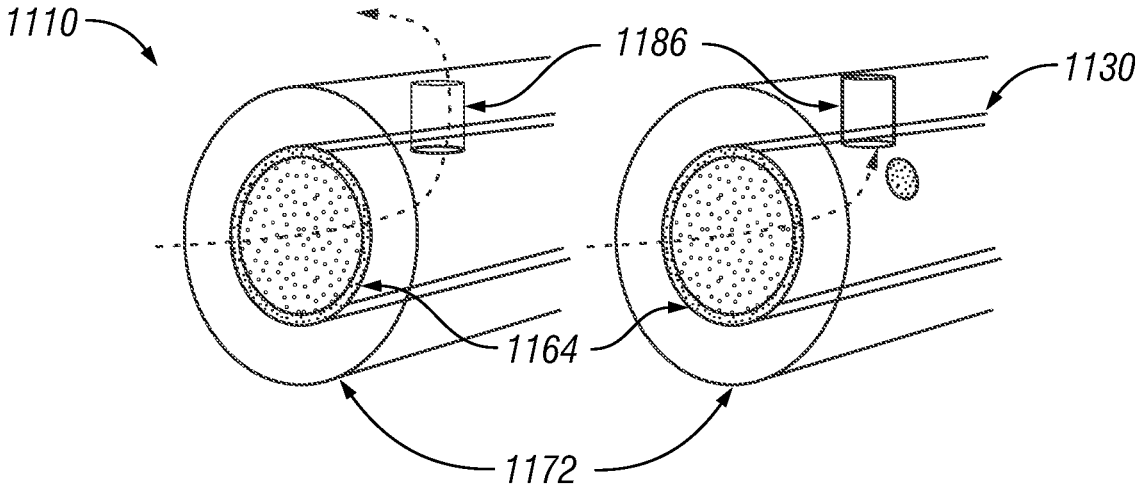
Figure 11B:
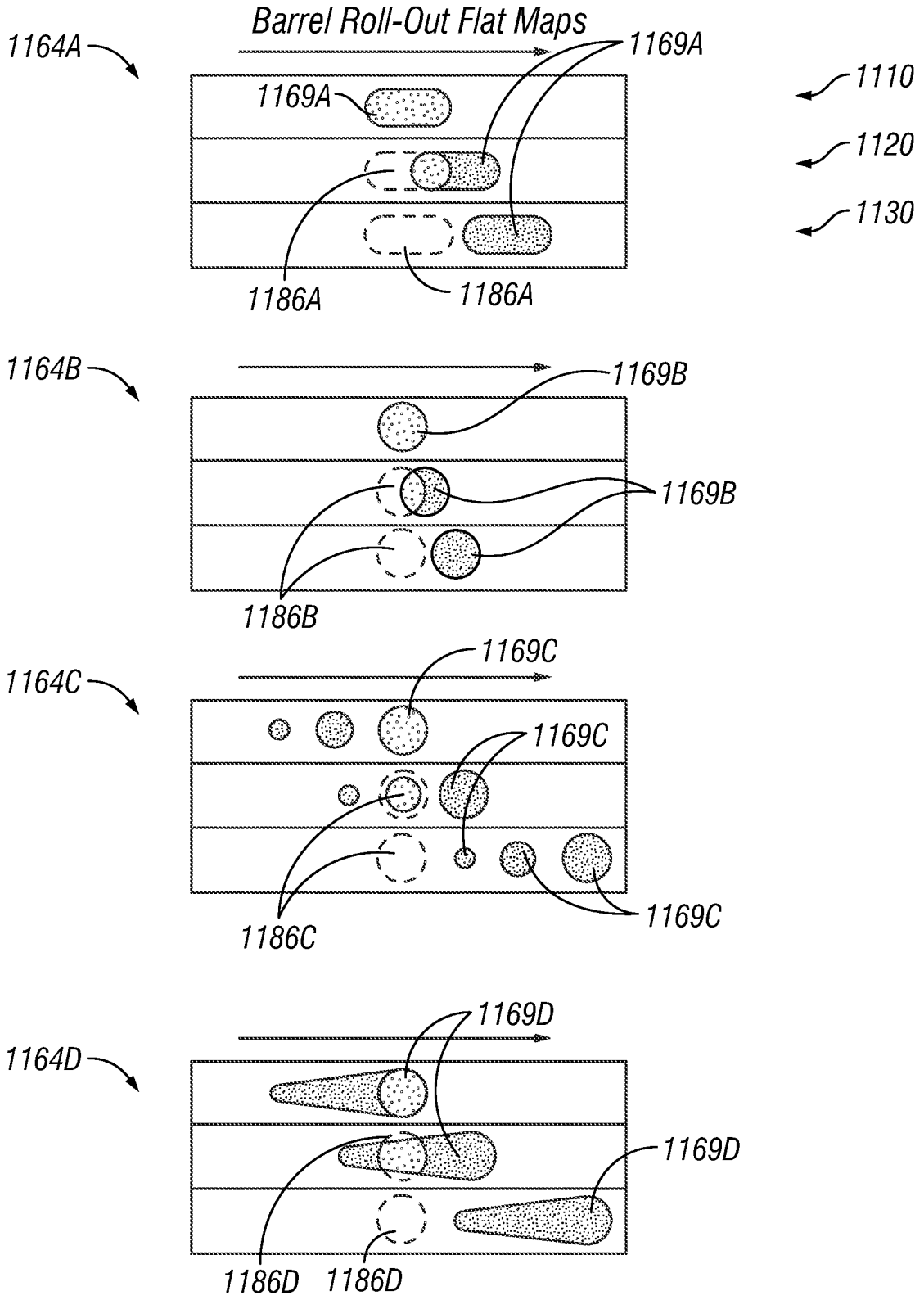

FIG. 11A shows a wireframe view of another suitable valve 1164 operating in two modes open 1110 and closed 1130, in accordance with one or more embodiments. The valve 1164 is a barrel type valve with a rotatable cylinder comprising an inlet 1169, which may take various forms as depicted in FIG. 11B. The inlet 1169 receives fluid, and when the valve 1164 is open, the inlet 1169 directs the fluid into the vent 1186 formed in the housing 72 of the BHA 40. As shown, the rotational position of the inlet 1169 determines whether the valve 1169 is open, partially, or closed. FIG. 11B shows layouts of the inlet 1169A-D in open 1110A-D, partially open 1120A-D, and closed positions 1130A-D, with respect to the vent 1186A-D. As the cylinder valve 1164A-D rolls, the outlet size of the valve 1164A-D varies from fully open to closed.

In addition to the embodiments described above, many examples of specific combinations are within the scope of the disclosure, some of which are detailed below:

Example 1. A drilling system for drilling a wellbore intersecting a subterranean earth formation, comprising: a drill string rotatable in a first direction in the wellbore; and a bottom hole assembly (BHA) locatable in the wellbore and comprising: a drill bit; a housing comprising a bore configured to receive fluid; a first fluid-driven motor in fluid communication with the bore and connected with and configured to rotate a portion of the BHA in a second direction opposite the first direction; a second fluid-driven motor in fluid communication with the bore and connected with and configured to rotate the drill bit; a valve in fluid communication with a vent comprising a flow path arranged to direct fluid away from any one or both of the fluid-driven motors; and a controller in communication with and configured to adjust a drilling parameter of the BHA by controlling the valve to adjust a flow rate of the fluid output from the valve into the vent.

Example 2. The system of Example 1, wherein the BHA further comprises a sensor configured to measure the drilling parameter.

Example 3. The system of Example 2, wherein the controller is further configured to adjust the drilling parameter to a desired drilling parameter value using the measured drilling parameter.

Example 4. The system of Example 1, wherein the controller is further configured to adjust a rotational speed of the first fluid-driven motor to maintain a stationary position for the portion of the BHA being rotated in the second direction.

Example 5. The system of Example 1, wherein the drilling parameter comprises any one or combination of a flow rate of the fluid in the housing, a pressure in the housing, a weight on bit, a torque on bit, a bend on bit, a rotational speed of the first fluid-driven motor, a rotational speed of the second fluid-driven motor, a rotational speed of the drill string, an azimuth of the BHA, a toolface of the BHA, or an inclination of the BHA.

Example 6. The system of Example 1, wherein the vent flow path is arranged to release some of the fluid outside of the housing to bypass any one or both of the fluid-driven motors.

Example 7. The system of Example 1, wherein the vent flow path is arranged to vent some of the fluid outside the housing to bypass any one or both of the fluid-driven motors.

Example 8. The system of Example 1, wherein the vent flow path is arranged to direct some of the fluid through a rotor of any or both of the fluid-driven motors.

Example 9. The system of Example 1, wherein the controller and valve are positioned between the fluid-drive motors.

Example 10. The system of Example 1, wherein the controller and valve are positioned upstream of the first fluid-driven motor.

Example 11. A method of drilling a wellbore intersecting a subterranean earth formation, comprising: rotating a drill string in a first direction coupled to a bottom hole assembly (BHA) in the wellbore; rotating a portion of the BHA in a second direction opposite the first direction using a first fluid-driven motor; rotating a drill bit coupled to the BHA using a second fluid-driven motor; and adjusting a drilling parameter of the BHA by controlling a flow rate of the fluid output from the valve into a vent.

Example 12. The method of Example 11, further comprising measuring the drilling parameter with a sensor in the wellbore.

Example 13. The method of Example 12, wherein adjusting comprises adjust the drilling parameter to a desired drilling parameter value using the measured drilling parameter.

Example 14. The method of Example 11, further comprising adjusting a rotational speed of the first fluid-driven motor to maintain a stationary position for the portion of the BHA being rotated in the second direction.

Example 15. The method of Example 11, wherein the drilling parameter comprises any one or combination of a flow rate of the fluid in the housing, a pressure in the housing, a weight on bit, a torque on bit, a bend on bit, a rotational speed of the first fluid-driven motor, a rotational speed of the second fluid-driven motor, an azimuth of the BHA, a toolface of the BHA, or an inclination of the BHA.

Example 16. The method of Example 11, further comprising releasing some of the fluid outside of the housing through the vent to bypass any one or both of the fluid-driven motors.

Example 17. The method of Example 11, further comprising venting some of the fluid outside the housing to bypass any one or both of the fluid-driven motors.

Example 18. The method of Example 11, further comprising directing some of the fluid through a rotor of any or both of the fluid-driven motors to bypass the respective fluid-driven motor.

Example 19. A bottom hole assembly (BHA) for drilling a wellbore intersecting a subterranean earth formation, comprising: a drill bit; a housing comprising a bore configured to receive fluid; a first fluid-driven motor in fluid communication with the bore and connected with and configured to rotate a portion of the BHA in a second direction opposite the first direction; a second fluid-driven motor in fluid communication with the bore and connected with and configured to rotate the drill bit; a valve in fluid communication with a vent comprising a flow path arranged to direct some of the fluid away from any one or both of the fluid-driven motors; a controller in communication with and configured to adjust a drilling parameter of the BHA by controlling the valve to adjust a flow rate of the fluid output from the valve into the vent.

Example 20. The BHA of Example 19, further comprising a sensor configured to measure the drilling parameter, and wherein the controller is further configured to adjust the drilling parameter to a desired drilling parameter value using the measured drilling parameter.

This discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A steerable drilling system for directionally drilling a wellbore intersecting a subterranean earth formation, comprising:

a drill string rotatable in a first direction in the wellbore; and a bottom hole assembly (BHA) configured to receive fluid and locatable in the wellbore and comprising:

a drill bit;

a first fluid-driven motor in fluid communication with a bore and connected with and configured to rotate a portion of the BHA in a second direction opposite the first direction;

a second fluid-driven motor in fluid communication with the bore and connected with and configured to rotate the drill bit;

a valve in fluid communication with a vent comprising a flow path arranged to direct fluid away from one or both of the fluid-driven motors; and a controller in communication with and configured to adjust a drilling parameter of the BHA to steer the drill bit by controlling the valve to adjust a flow rate of the fluid output from the valve into the vent, wherein the controller is further configured to adjust a rotational speed of the first fluid-driven motor rotating the portion of the BHA in the second direction opposite the first direction so that the portion of the BHA is stationary in the wellbore while the drill bit is rotating in the second direction.

2. The system of claim 1, wherein the BHA further comprises a sensor configured to measure the drilling parameter.

3. The system of claim 2, wherein the controller is further configured to adjust the drilling parameter to a desired drilling parameter value using the measured drilling parameter.

4. The system of claim 1, wherein the drilling parameter comprises any one or combination of a flow rate of the fluid in the BHA, a pressure in the BHA, a weight on bit, a torque on bit, a bend on bit, a rotational speed of the first fluid-driven motor, a rotational speed of the second fluid-driven motor, a rotational speed of the drill string, an azimuth of the BHA, a toolface of the BHA, or an inclination of the BHA.

5. The system of claim 1, wherein the vent flow path is arranged to release some of the fluid out of a side of the BHA to bypass one or both of the fluid-driven motors.

6. The system of claim 1, wherein the vent flow path is arranged to vent some of the fluid outside the BHA to bypass one or both of the fluid-driven motors.

7. The system of claim 1, wherein the vent flow path is arranged to direct some of the fluid through a rotor of one or both of the fluid-driven motors.

8. The system of claim 1, wherein the controller and valve are positioned between the fluid-driven motors.

9. The system of claim 1, wherein the controller and valve are positioned upstream of the first fluid-driven motor.

10. A method of directionally drilling a wellbore intersecting a subterranean earth formation, comprising:

rotating a drill string in a first direction coupled to a bottom hole assembly (BHA) in the wellbore;

rotating a portion of the BHA in a second direction opposite the first direction using a first fluid-driven motor powered by a fluid;

rotating a drill bit coupled to the BHA using a second fluid-driven motor powered by the fluid;

operating a valve to selectively direct some of the fluid away from one or both of the fluid-driven motors; and steering the drill bit by adjusting a drilling parameter of the BHA by controlling a flow rate of the fluid output from the valve into a vent, adjusting a rotational speed of the first fluid-driven motor rotating the portion of the BHA in the second direction opposite the first direction so that the portion of the BHA is stationary in the wellbore while the drill bit is rotating in the second direction.

11. The method of claim 10, further comprising measuring the drilling parameter with a sensor in the wellbore.

12. The method of claim 11, wherein adjusting comprises adjust the drilling parameter to a desired drilling parameter value using the measured drilling parameter.

13. The method of claim 10, wherein the drilling parameter comprises any one or combination of a flow rate of the fluid in the BHA, a pressure in the BHA, a weight on bit, a torque on bit, a bend on bit, a rotational speed of the first fluid-driven motor, a rotational speed of the second fluid-driven motor, an azimuth of the BHA, a toolface of the BHA, or an inclination of the BHA.

14. The method of claim 10, further comprising releasing some of the fluid out of a side of the BHA through the vent to bypass one or both of the fluid-driven motors.

15. The method of claim 10, further comprising venting some of the fluid outside the BHA to bypass one or both of the fluid-driven motors.

16. The method of claim 10, further comprising directing some of the fluid through a rotor of one or both of the fluid-driven motors to bypass the respective fluid-driven motor.

17. A bottom hole assembly (BHA) for directionally drilling a wellbore intersecting a subterranean earth formation, comprising:

a drill bit;

a first fluid-driven motor in fluid configured to receive fluid and connected with and configured to rotate a portion of the BHA in a second direction;

a second fluid-driven motor in fluid communication with a bore and connected with and configured to rotate the drill bit in a first direction opposite the second direction;

a valve in fluid communication with a vent comprising a flow path arranged to direct some of the fluid away from one or both of the fluid-driven motors;

a controller in communication with and configured to adjust a drilling parameter of the BHA to steer the drill bit by controlling the valve to adjust a flow rate of the fluid output from the valve into the vent, wherein the controller is further configured to adjust a rotational speed of the first fluid-driven motor rotating the portion of the BHA in the second direction opposite the first direction so that the portion of the BHA is stationary in the wellbore while the drill bit is rotating in the first direction.

18. The BHA of claim 17, further comprising a sensor configured to measure the drilling parameter, and wherein the controller is further configured to adjust the drilling parameter to a desired drilling parameter value using the measured drilling parameter.

* * * * *